United States Patent [19]

Jordan

[11] Patent Number: 4,665,949

[45] Date of Patent: May 19, 1987

[54] CATCHER

[75] Inventor: Raymond M. Jordan, Joplin, Mo.

[73] Assignee: Ingersoll-Rand Company, Woodcliff Lake, N.J.

[21] Appl. No.: 884,778

[22] Filed: Jul. 11, 1986

[51] Int. Cl.[4] ..... B26D 3/00

[52] U.S. Cl. ..... 138/37; 83/53

[58] Field of Search ..... 83/53, 177; 138/30, 138/37, 39, 40, 41, 46

[56] References Cited

U.S. PATENT DOCUMENTS

| | | | |
|---|---|---|---|
| 1,942,598 | 1/1934 | Hewgley | 138/37 X |
| 2,327,449 | 8/1943 | Parker | 138/37 |
| 2,420,544 | 5/1947 | Jones | 138/46 X |
| 2,830,621 | 4/1958 | Prescott | 138/46 |
| 4,532,949 | 8/1985 | Frank | 83/53 X |

*Primary Examiner*—Stephen Marcus
*Assistant Examiner*—Mark Thronson
*Attorney, Agent, or Firm*—Bernard J. Murphy

[57] ABSTRACT

In the embodiment depicted, the catcher, for use with a liquid-jet-cutting equipment, comprises a housing in which is formed a chamber, and the chamber replaceably confines an impingement block. A channel opens into the chamber and onto the block for admitting and dissipating a stream of spent, cutting liquid, and for directing the liquid through a discharge port in the housing to a reservoir. The impingement block is replaceable in the housing by removing a threaded closure from an underlying housing wall.

7 Claims, 2 Drawing Figures

CATCHER

This invention pertains to catchers for use with liquid-jet-cutting equipment, for decelerating, de-energizing, and directing spent, cutting liquid to a reservoir Prior art catchers of the aforesaid type commonly employ a housing with a liquid-receiving chamber therein. In such chambers, typically there is an integral, arcuate trough, or spiral-shaped or scroll-shaped volute in which is received a stream of spent, cutting liquid. The troughs or volutes channel the liquid, decelerate the same, and dissipate its energy. With use, the troughs and/or volutes become worn and, as a consequence, it is necessary to replace the housings. What has been long sought is an improved catcher having means disposed within a housing chamber, which impingingly receives the spent, cutting liquid, and yet is replaceable, by itself, so that the housing need not be expendable.

It is an object of this invention to set forth an improved catcher, for a stream of spent, cutting liquid which avoids the disadvantages of the prior art type. It is particularly an object of this invention to set forth a catcher, for a stream of spent, cutting liquid, for use with liquid-jet-cutting equipment, comprising a housing; said housing having a chamber formed therein; a channel, formed within said housing, for admitting spent, cutting liquid therethrough and into said chamber; a port, formed in said housing, for discharging cutting liquid therethrough from said chamber; and means disposed in said chamber for (a) impingingly receiving a stream of spent, cutting liquid via said channel, and (b) decelerating the channel-admitted liquid, and directing it to said port; wherein said means is replaceably disposed in said chamber.

Figure 1:
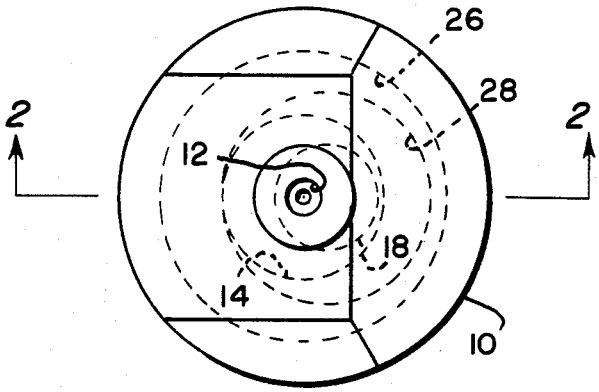
Figure 2:
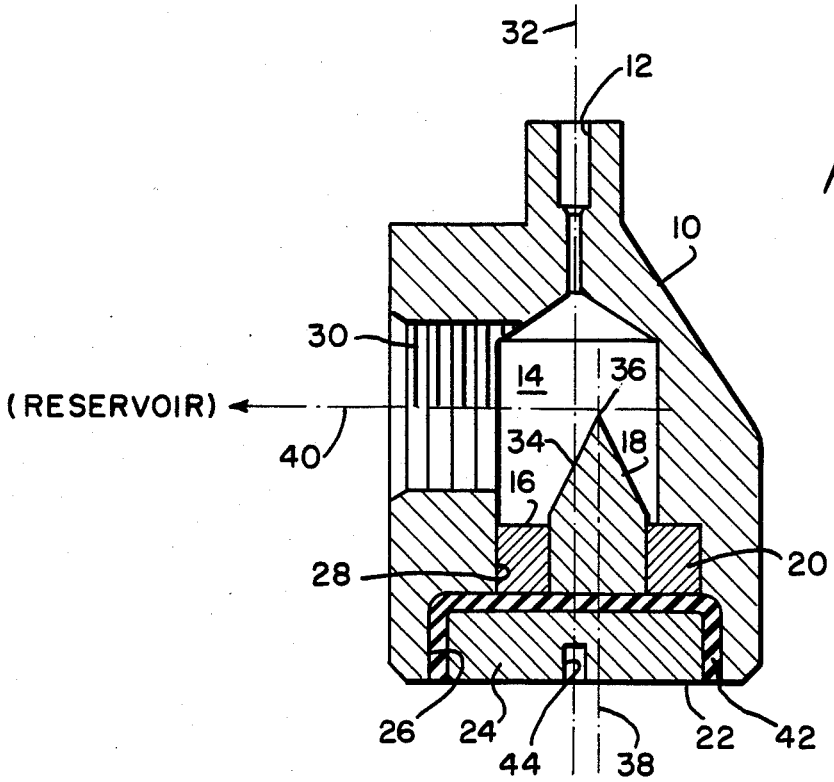

Further objects of this invention, as well as the novel features thereof, will become more apparent by reference to the following description, taken in conjunction with the accompanying figures, in which:

FIG. 1 is a plan view, or a top view, of the catcher according to an embodiment of the invention; and FIG. 2 is a cross-sectional view of the catcher of FIG. 1 taken along section 2—2 of FIG. 1.

As shown in the figures, the catcher comprises a housing 10 which has a channel 12 formed therein, through the top thereof, which opens into an inner chamber 14. The channel is provided for receiving therethrough (from the nozzle of a liquid-jet-cutter, not shown) a stream of spent, cutting liquid. Within the chamber 14 is confined an impingement block 16. The latter comprises an insert 18 which is soldered into an apertured base 20. Both the insert 18 and the base 20 are formed of a hard material; in this embodiment the material is tungsten carbide.

In the bottom of the housing 10 is an underlying wall 22 in which is threadedly secured a closure 24. The closure 24 is received in a first, circular, threaded aperture 26, formed in an outer portion of the wall 22, which, in turn, opens into a second, circular, unthreaded aperture 28 formed in an inner portion of the wall 22. The base 20 of the impingement block 16 is nested in the aforesaid second aperture 28.

The housing 10 has a discharge port 30 formed therein, and extending normal to the axis 32 of the channel 12, and the insert 18 has a liquid impingement surface 34 of conical configuration. The spent, cutting liquid courses through the channel 12, and impinges on the conical surface 34 whereupon its energy is dissipated and its velocity reduced. Additionally, the liquid is deflected and expelled through the port 30.

The insert 18 has a vertex 36 which is offset from the axis 32 of the channel 12. The insert itself has a central axis 38 which bisects the axis 40 of the port 30.

Between the base 20 and the closure 24 there is confined an elastomeric disc 42. The disc 42 accommodates for, or damps, shock and vibration as these occur during the impingement of the liquid upon the surface 34 of the insert. As can be seen, the closure 24 has a drive slot 44 for receiving a tool by means of which the impingement block 16 can be removed. By threadedly removing the closure 24, the block 16 comes free of the aperture 28; as needed, a replacement block 16 can be installed and secured in the aperture 28 by the closure 24.

While I have described my invention in connection with a specific embodiment thereof, it is to be clearly understood that this is done only by way of example, and not as a limitation to the scope of my invention as set forth in the objects thereof, and in the appended claims.

I claim:

1. A catcher, for a stream of spent, cutting liquid, for use with liquid-jet-cutting equipment, comprising:

a housing;

said housing having a chamber formed therein;

a channel, formed within said housing, for admitting spent, cutting liquid therethrough and into said chamber;

a port, formed in said housing, for discharging cutting liquid therethrough from said chamber; and means disposed in said chamber for (a) impinginly and only obliquely receiving a stream of spent, cutting liquid via said channel, and (b) decelerating the channel-admitted liquid, and directing such liquid therefrom, only obliquely, to said port; wherein said means is replaceably disposed in said chamber;

said means has a liquid impingement surface;

said means comprises an impingement block;

said surface is conical, and has a vertex;

said channel has a given, elongate axis;

said elongate axis and said vertex are offset from each other:

said block has a central axis; and said elongate axis of said channel, and said central axis of said block are parallel.

2. A catcher, according to claim 1, wherein:

said surface is oblique to, and traverses, said elongate axis.

3. A catcher, according to claim 1, wherein:

said housing has a given wall; and said wall has an opening formed therein; and further including a closure removably set into said opening; wherein said closure comprises means for securing said block in said chamber.

4. A catcher, according to claim 3, wherein:

said opening has a first, circular, and threaded aperture, and a second, circular, unthreaded aperture;

said apertures have centers which are offset from each other;

said first aperture is formed in an outer surface of said wall; and said second aperture is formed in an inner surface of said wall.

5. A catcher, according to claim 4, wherein:

said impingement block nests in said second aperture; and said closure is threadedly engaged with said first apertures.

6. A catcher, according to claim 5, further including:

means interpositioned between said closure and said block, for suppressing shock and vibration.

7. A catcher, according to claim 6, wherein:

said shock and vibration-suppressing means comprises an elastomeric disc.

* * * * *